United States Patent [19]

Clark, Jr.

[11] 4,385,782

[45] May 31, 1983

[54] FOLDING SEAT STRUCTURE

[76] Inventor: Alexander B. Clark, Jr., Box 2012, Hendersonville, N.C. 28793

[21] Appl. No.: 816,022

[22] Filed: Jul. 15, 1977

Related U.S. Application Data

[63] Continuation of Ser. No. 584,481, Jun. 6, 1975, abandoned, and a continuation-in-part of Ser. No. 490,766, Jul. 22, 1974, abandoned.

[51] Int. Cl.[3] ..... A47C 7/02

[52] U.S. Cl. ..... 297/230; 297/350; 297/352

[58] Field of Search ..... 297/352, 350, 111, 230, 297/380; 229/39 R; 312/259; 5/DIG. 1

[56] References Cited

U.S. PATENT DOCUMENTS

| | | | |
|---|---|---|---|
| 2,001,252 | 5/1935 | Johnson | 297/350 |
| 2,710,646 | 6/1955 | Kirby | 297/352 X |
| 3,053,569 | 9/1962 | Clark, Jr. | 297/111 |
| 3,359,036 | 12/1967 | Druth et al. | 297/352 |

*Primary Examiner*—William E. Lyddane
*Attorney, Agent, or Firm*—Ralph Bailey

[57] ABSTRACT

A seat structure of carboard and the like is illustrated wherein a seat portion and a back portion as well as flaps provided for interconnecting the seat and the back are formed from a single blank providing a foldable seat for use upon bleachers and the like as when attending sporting events. The flaps are insertable within a pair of inwardly converging slots carried in the seat portion to resist the force exerted by a user leaning back.

3 Claims, 4 Drawing Figures

FOLDING SEAT STRUCTURE

This is a continuation of copending application Ser. No. 584,481, filed June 6, 1975, now abandoned, and a continuation in part of application Ser. No. 490,766 filed July 22, 1974, now abandoned.

This invention relates to a seat structure which is formed from a single blank, requiring no additional accessories of any kind, and which may be readily assembled for providing an individualized seat structure capable of a variety of uses.

BACKGROUND OF THE INVENTION

The seat structure hereof is an improvement upon the seat structure illustrated in U.S. Pat. No. 3,053,569. The structure of the patent is highly useful and successful in many respects, but it possesses the disadvantage of requiring the use of tape, thus requiring additional processing during manufacturing. Seat structures of the prior art such as that illustrated in U.S. Pat. No. 3,359,036 utilize a single central notch utilizing cardboard sufficient for the brace panels to extend to the middle of the seat and back and to form a tab when an individual is seated and leans back the sides tend to close in. The corners formed by the seat back and sides are unoccupied by an individual thus seated so that full use is not made of the construction material.

It is an important object of this invention to provide a seat structure which may be stamped or formed by a rotary press from a single cardboard blank and the like utilizing a minimum of cardboard and the like. The seat structure may be die cut from a single blank, and it is possible to print advertising material on the back thereof at the same time.

Another important object of the invention is to provide a seat structure which may be used for a variety of purposes and which may be readily stacked, assembled and shipped. For example, the seat structure may be folded containing a recording and wrapped in shrink wrapping for shipping of records and the like. The seat may be later utilized for its intended purpose at games and the like. The seat structure may be given away for advertising purposes or it may be sold.

SUMMARY OF THE INVENTION

It has been found that a folding cardboard seat structure may be formed from a single blank by providing a transverse score forming a seat and back portion with marginal flaps extending from the back portion and downwardly extending flaps depending from the first mentioned flaps for insertion in inwardly converging slots carried by the seat portion and folded down against the seat for assembling the seat components in position for use.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The drawings illustrate folding cardboard seat structure including an elongated substantially rectangular blank A having longitudinal fluting. A transverse score B in said blank forms a seat and a back portion. Spaced longitudinal, marginal scores C in the back portion extend from the transverse score defining marginal back flaps extending outwardly from the back portion. A marginal downwardly extending flap D is hinged adjacent each end of the transverse score B, being severed from the seat portion and extending on each side thereof. A pair of inwardly converging slots E are carried in the seat portion for receiving respective downwardly extending flaps D. Thus, the downwardly extending flaps may be inserted from the underside of the seat into the slots and folded against the seat portion positioning the back in upright position providing individualized seating upon stadium seats and the like.

Figure 1:
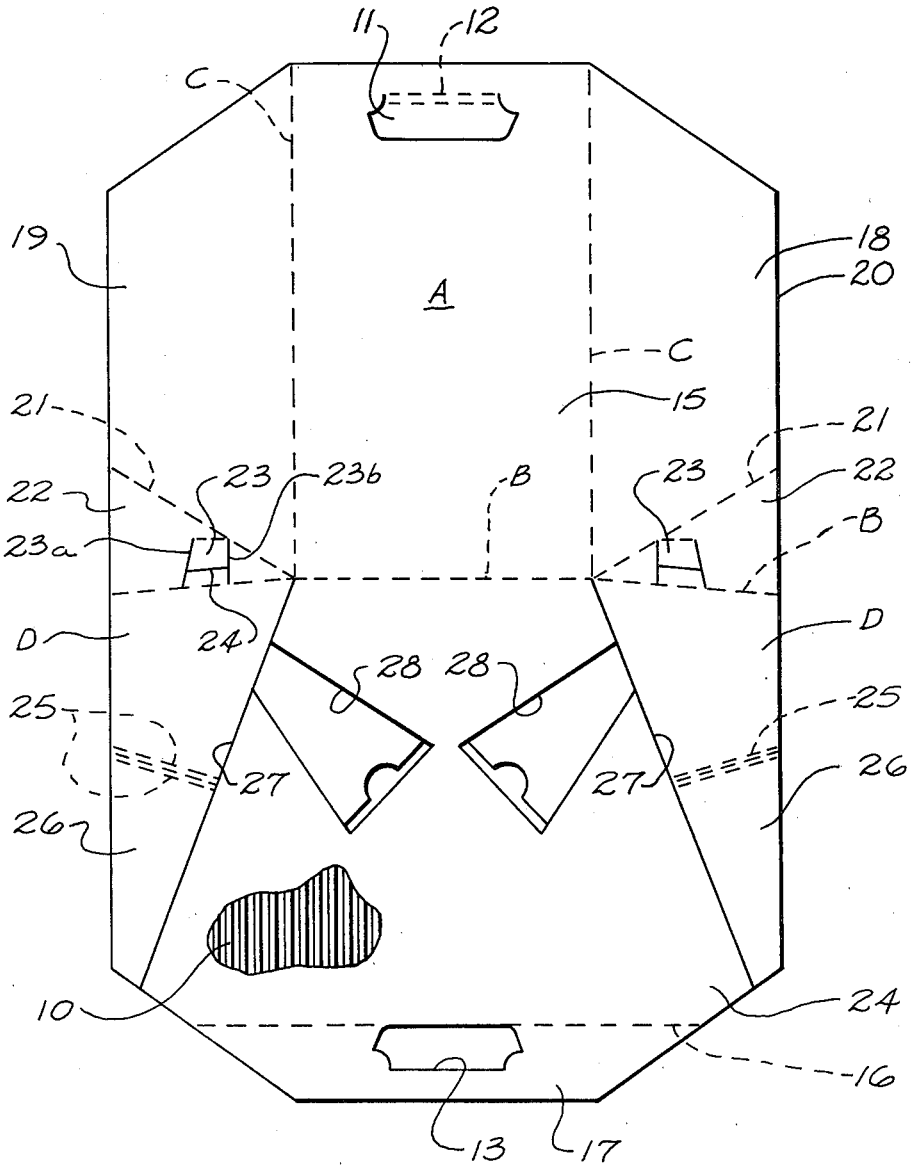
FIG. 1 is a top plan view illustrating the single cardboard blank having been stamped and otherwise prepared for use as a seat structure hereof in accordance with the present invention.
Figure 2:
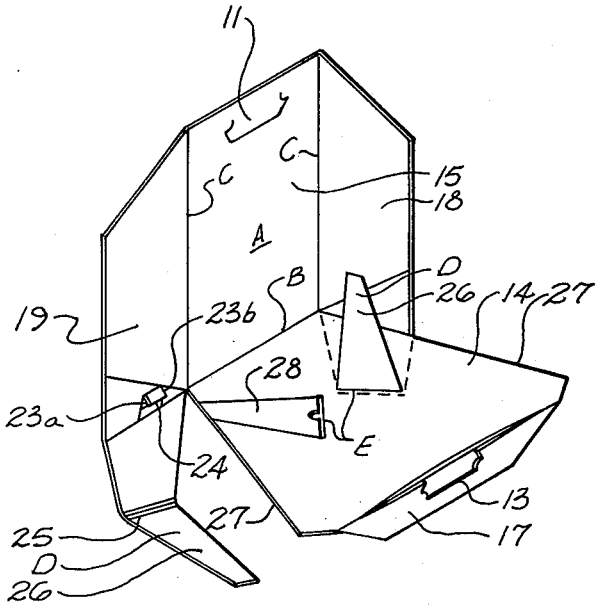
FIG. 2 is a perspective view illustrating a first step in the assembly of the components of the seat structure.
Figure 3:
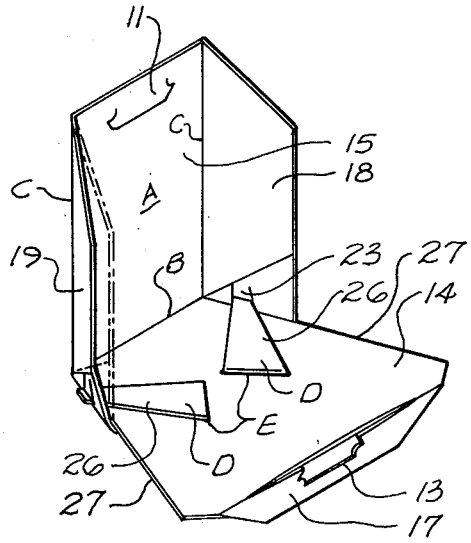
FIG. 3 is a perspective view illustrating a further step in the assembly of the seat components.
Figure 4:
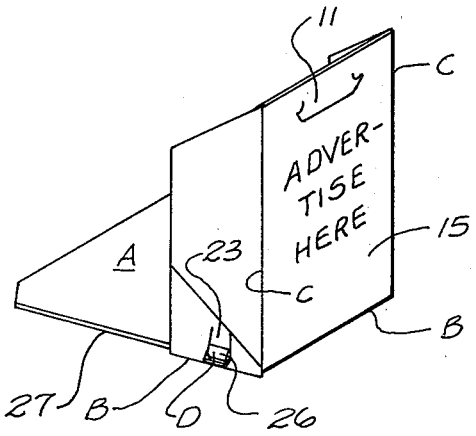
FIG. 4 is an assembled view looking toward the rear of the fully assembled seat structure.

The elongated, rectangular blank A has longitudinal fluting 10 (FIG. 1). The seat is adapted to be folded along a transverse score which is illustrated in the form of a score B opening on the lower face of the blank. The seat structure may be carried in folded position by folding the flaps inwardly and by engaging a flap 11 which is hinged at score 12 in a complimentary cutout portion 13 carried adjacent a remote end of the blank. The transverse score B forms a seat portion 14 and a back portion 15. A similar parallel slit score 16 is carried adjacent the remote end of the blank and may be folded downwardly as illustrated in FIGS. 2, 3 and 4 forming a forward portion 17 extending over the front edge of a stadium seat and the like for positioning the seat structure hereof thereon.

Spaced longitudinal marginal scores C are illustrated as extending upwardly substantially at right angles from the transverse score B defining marginal back flaps 18 and 19. It will be observed that marginal downwardly extending flaps D are hinged adjacent each end of the transverse score B and that they are severed entirely from the seat portion and extend on each side thereof. The back flaps 18 and 19 have outer edges 20 which extend toward the depending flaps D and form a common outer edge therewith. An intermediate score 21 extends outwardly from the junction of the scores C and B. A substantially V-shaped flap 22 is thus provided bridging the flaps 18 and 19 and respective downwardly extending flaps D carried thereby. A further substantially V-shaped flap 23 is hinged on one side but it has otherwise free edges **23*a* and 23*b*** which extend toward a free base.

It will be observed that each of the downwardly extending flaps have double scored portions 25 extending thereacross intermediate their ends to facilitate insertion of tip portions 26 within the inwardly converging slots E and to accommodate the thickness of the seat portion 14. It will be further observed by reference to FIG. 3 that, after insertion of the tip portion, by depressing the tip portions 26 across the cut out flaps 23 that the base portions 24 of the flaps will snap thereover after which the flaps D will be held in interlocking relationship thereto.

It is important to note that since the flaps after insertion and positioned beneath the cutout flaps 23 maintain the seat in open position. This is important since spectators at sporting events often jump up and down and it is important that the seat remain in open position.

It will be observed that the seat portion 14 tapers rearwardly as at 27 toward the transverse score B with which it is joined. The flaps D are initially formed by cutting along the line 27. The flaps D are each severed from the seat portion substantially along lines 27 extending from forward portions of said seat portion on each side thereof. The flaps extend on each side of the seat portion which tapers inwardly from front to rear. Since the transverse score B includes opposed downwardly inclined terminal portions, FIG. 1, extending outwardly from each end of an intermediate portion between the marginal scores C the seat is maintained in fully open position as shown in FIGS. 3 and 4 with the back tilted rearwardly. The opposed downwardly inclined portions form the base of the V-shaped flaps 22, serving as a hinge for the depending flaps D, which bears upon the tapering portions 27 when the seat is in open position.

It will be noted that a depression or recess, 28 is created as in the upper seat portion as by a brush score when said blank is stamped out. The recess is of a configuration to preferably snugly receive an overlying portion of the flaps D when in folded position for aiding in producing a more nearly even or smooth seat portion for supporting an individual when sitting with the seat in open assembled configuration. As illustrated the recesses extend outwardly of the converging slots E toward the V-shaped flaps 22 within which the flaps D are locked.

Since the inwardly converging slots are at an angle to the force exerted through the flaps D when supporting an individual in the area of the V-shaped flap portion 22 and are therefore, more effective in resisting the force than are the brace panels of the prior art, less material of a lighter weight has been found suitable for the seats illustrated herein to provide a more stable support for a person of comparable size.

While a preferred embodiment of the invention has been described using specific terms, such description is for illustrative purposes only, and it is to be understood that changes and variations may be made without departing from the spirit or scope of the following claims.

What is claimed is:

1. A folding cardboard seat structure including:

an elongated substantially rectangular blank having longitudinal fluting, a transverse score in said blank forming a seat portion and a back portion, spaced substantially longitudinal, marginal scores in said back portion extending from said transverse score defining marginal back flaps extending outwardly from said back portion, a marginal, downwardly extending flap hinged adjacent a lower edge of each of said marginal back flaps and being severed from said seat portion and extending on each side of said seat portion along inclined lines extending from forward portions of said seat portion on each side thereof and tapering inwardly rearwardly toward said transverse score and said marginal scores in said back portion, said transverse score including opposed downwardly inclined terminal portions from which said marginal downwardly extending flaps are hinged, a pair of inwardly converging elongated slots carried in said seat portion for receiving respective downwardly extending flaps, means for locking a forward free end of each of said downwardly extending flaps when folded against the seat portion positioning the back in upright position, and said marginal back flaps diverging from said back portion in open position at such an angle that said opposed downwardly inclined terminal portions of said transverse score are in alignment with said lines extending from forward portions of said seat portion, whereby the back of an occupant of the seat is supported in the area adjacent said marginal back flaps.

2. The structure set forth in claim 1 including, an intermediate score extending outwardly and upwardly from said transverse score in said base portion between said marginal scores and said transverse score forming a V-shaped flap wherein said first mentioned flaps are locked.

3. The structure set forth in claim 1 including a recess in said seat portion extending from each of said converging slots outwardly receiving an overlying portion of said flaps when in folded position for aiding in producing a more nearly even seat portion when sitting.

* * * * *